US006692166B2

(12) United States Patent
Ansell et al.

(10) Patent No.: US 6,692,166 B2
(45) Date of Patent: Feb. 17, 2004

(54) FRANKING MACHINE WITH A CLAMPING DEVICE FOR AN ITEM OF MAIL

(75) Inventors: Iain Ansell, Newmarket (GB); Steven Roland Brace, Cambridgeshire (GB)

(73) Assignee: Francotyp-Postalia AG & Co., Birkenwerder (DE)

( * ) Notice: Subject to any disclaimer, the term of this patent is extended or adjusted under 35 U.S.C. 154(b) by 0 days.

(21) Appl. No.: 10/103,376

(22) Filed: Mar. 21, 2002

(65) Prior Publication Data

US 2002/0136580 A1 Sep. 26, 2002

(30) Foreign Application Priority Data

Mar. 21, 2001 (DE) ..... 101 14 530.6

(51) Int. Cl.[7] ..... B41J 11/00

(52) U.S. Cl. ..... 400/56; 400/55; 400/103; 101/71; 101/91

(58) Field of Search ..... 101/71, 91; 400/55, 400/56, 57, 58, 59, 103

(56) References Cited

U.S. PATENT DOCUMENTS

| | | | | |
|---|---|---|---|---|
| 4,227,819 A | | 10/1980 | Manriquez | |
| 4,461,212 A | | 7/1984 | Geney | |
| 4,739,343 A | * | 4/1988 | Dolan | 347/214 |
| 4,763,575 A | | 8/1988 | Miciukiewicz | |
| 4,872,521 A | | 10/1989 | Abellana et al. | |
| 5,339,733 A | * | 8/1994 | Malin | 101/91 |
| 5,427,025 A | | 6/1995 | Lee et al. | |
| 5,547,292 A | | 8/1996 | Harada | |
| 5,640,903 A | * | 6/1997 | Salomon | 101/91 |
| 5,899,615 A | * | 5/1999 | Sansone | 400/188 |
| 5,949,444 A | | 9/1999 | Geserich et al. | |
| 5,988,057 A | * | 11/1999 | Salomon et al. | 101/91 |
| 6,007,178 A | | 12/1999 | Asano | |

FOREIGN PATENT DOCUMENTS

| | | |
|---|---|---|
| DE | 38 11 539 A1 | 10/1988 |
| DE | 195 02 433 A1 | 8/1995 |
| DE | 196 05 015 C1 | 3/1997 |
| EP | 0 405 356 B1 | 11/1994 |
| EP | 0 825 563 A2 | 2/1998 |

* cited by examiner

*Primary Examiner*—Andrew H. Hirshfeld
*Assistant Examiner*—Dave A. Ghatt
(74) *Attorney, Agent, or Firm*—Laurence A. Greenberg; Werner H. Stemer; Ralph E. Locher

(57) ABSTRACT

The franking machine has a clamping device which can be driven via a drive device and which securely clamps an item of mail to be franked against a stop element. The clamping device has a clamping unit, which is provided for interacting with the item of mail, and a gearing device which is connected to the clamping unit and the drive device. The gearing device displaces the clamping unit in the direction of the stop element. The clamping unit and/or the gearing device have at least one compensation section which is configured elastically such that, in the case of a predetermined drive displacement of the drive device, compensation for different thicknesses of the item of mail is provided by elastic deformation of the compensation section.

15 Claims, 6 Drawing Sheets

FRANKING MACHINE WITH A CLAMPING DEVICE FOR AN ITEM OF MAIL

BACKGROUND OF THE INVENTION

Field of the Invention

The invention relates to a franking machine having a clamping device which can be driven via a drive device and by means of which an item of mail to be franked is securely clamped against a stop element. The clamping device comprises a clamping unit, which is provided for interacting with the item of mail, and a gearing device, which is connected to the clamping unit and the drive device and is intended for displacing the clamping unit in the direction of the stop element.

Conventional franking machines may be subdivided roughly into two groups depending on the volume of mail that is to be processed. The franking machines which are designed for a relatively large amount of mail are usually equipped with a transporting mechanism for the letter which is to be processed. In contrast, in the case of franking machines for a relatively small amount of mail, for example in the range of fewer than 20 to 30 letters per day, the letter usually has to be introduced and removed manually.

In order to ensure reliable positioning of a letter in relation to the printing head during printing of the franking mark, a clamping device is usually provided in the case of the franking machines wherein letters are fed manually, the clamping device clamping the letter against a stop plate, in order to fix it, during the printing operation. Provided in this stop plate is a printing window through which the printing head can print the letter with the franking mark.

In this context, it usually has to be ensured that it is possible to process letters of different thicknesses over a certain range. The maximum thicknesses to be processed here are usually in the region of 10 mm (0.4 in). It is thus necessary for the clamping mechanism and/or the drive thereof, to be configured such that they can compensate for different letter thicknesses.

U.S. Pat. No. 6,007,178 (see European published patent application EP 0 825 563 A2) discloses a franking machine of the generic type. There, the thickness compensation is achieved in that the clamping plate which presses the letter against the stop plate is pressed against the letter by two helical springs supported on the base of the franking machine. Depending on the thickness of the letter, a corresponding excursion of the helical springs is produced here. The drive device via which the clamping device can be opened and closed is coupled to the clamping plate via a rocking lever, of which the end which is directed away from the clamping plate runs on a cam plate, connected to the drive device. The drive device, rather than applying the clamping force, applies the force for opening the clamping device counter to the spring force of the helical springs. With each action for securely clamping the letter, the drive device always executes a predetermined drive displacement which corresponds to half a revolution of the cam plate.

This configuration, however, first of all has the disadvantage that, as a result of the helical springs having to be supported on the base of the franking machine, the clamping mechanism takes up a comparatively large amount of space in the interior of the franking machine, as a result of which the installation space taken up by the franking machine is increased overall.

This is not particularly desirable, not least from an esthetic point of view. It is precisely in relatively small offices or the like, for which this type of franking machine is intended, that there is often also a problem with space, with the result that, for this reason as well, the aim is to achieve the smallest possible configuration.

A further disadvantage of this known configuration is that the clamping force achieved varies to a very pronounced extent depending on the thickness of the letter which is to be clamped. Depending on the nature of the letter, the latter is then pressed into the printing window to a more or less pronounced extent, this resulting, in some circumstances, in a greatly varying distance between the printing head and letter, which may have an adverse effect on the printing result.

SUMMARY OF THE INVENTION

It is accordingly an object of the invention to provide a franking machine with a clamping device for a piece of mail, which overcomes the above-mentioned disadvantages of the heretofore-known devices and methods of this general type and which provides for a franking machine with the smallest possible clamping configuration along with a low variation in the clamping force.

With the foregoing and other objects in view there is provided, in accordance with the invention, a franking machine, comprising:

- a clamping device configured to clamp an item of mail to be franked against a stop element;
- a drive device for driving the clamping device;
- the clamping device including a clamping unit configured to interact with the item of mail, and a gearing device connected to the clamping unit and the drive device for displacing the clamping unit in a direction towards the stop element; and
- the clamping unit and/or the gearing device having an elastic compensation section, the compensation section, upon a predetermined drive displacement of the drive device, compensating for different thicknesses of the item of mail by elastic deformation of the compensation section.

The invention is based on the technical teaching that a small franking machine is obtained if the clamping unit and/or the gearing device have/has at least one compensation section which is designed elastically such that, in the case of a predetermined drive displacement of the drive device, compensation for different thicknesses of the item of mail is provided by elastic deformation of the compensation section.

By virtue of the compensation mechanism being integrated according to the invention in the clamping unit and/or the gearing device, it is possible, in contrast to the known franking machine, to save a considerable amount of installation space, which is then available for the arrangement of other functional units of the franking machine, as a result of which a smaller franking machine is advantageously achieved.

Furthermore, by virtue of the compensation section being arranged and/or configured in a suitable manner, it is possible to achieve a configuration with a considerably lower variation in the clamping force for different thicknesses of items of mail.

It is thus readily possible for the compensation section to be of a sufficiently long length, which results in its elastic deformation behavior having a smooth characteristic curve, which in turn results in a low variation in the clamping force, even in the case of relatively large thickness variations, i.e. relatively large variations in the clamping displacement. It is also possible, in addition, for the compensation section to be arranged at a large distance from the clamping device in a region which, throughout the clamping movement, is only subjected to relatively small deflections in any case, with the result that, with the elastic deformation behavior of the compensation section having a sufficiently smooth characteristic curve, as mentioned above, comparatively small variations in the clamping force are produced.

A further advantage of the configuration according to the invention is that, by virtue of the compensation mechanism being integrated in the clamping unit and/or the gearing device, it is always possible for there to be a force-fitting or form-fitting connection between the links of the active chain, while that end of the rocking lever of the known franking machine which interacts with the cam plate, depending on the thickness of the item of mail which is to be processed, during the secure-clamping operation, lifts off from the cam plate to a more or less pronounced extent. This is both advantageous in terms of noise and favorable in terms of the wear to which the clamping mechanism is subjected.

The compensation section may be arranged as desired within or on the clamping unit and, in addition or alternatively, within or on the gearing device.

In the case of variants of the franking machine according to the invention which are preferred because they are of particularly straightforward configuration, the gearing device comprises a first lever arm, a first compensation section then being arranged on the lever arm.

It is possible here for the first compensation section to continue the contour of the first lever arm without any transition and merely to consist of a correspondingly more elastic material. In order to achieve the length which is necessary for the low variation in clamping force and/or the smooth characteristic curve, it may preferably be provided that the compensation section extends over at least more or less the entire first lever arm or forms the same.

The first compensation section is preferably formed by a leaf-spring-like spring section of the first lever arm, since such a configuration can be realized in a particularly straightforward manner.

Furthermore, it is preferably provided that the spring section has at least one bending section with a U-shaped profile. On the one hand, this makes it possible to achieve, even in a constricted amount of space, a particularly long compensation section which has a particularly smooth characteristic curve with a low variation in clamping force. On the other hand, this makes it possible to achieve, even in the case of constricted space conditions, relatively large spring excursions, as a result of which a large variation in thickness of the processable items of mail is possible.

As has been mentioned, a compensation section may also be arranged in the region of the clamping unit. It is thus possible for the clamping unit to comprise, for example, a clamping plate which interacts with the item of mail, is arranged in a movable manner in or on a clamping plate carrier and, depending on the thickness of the item of mail which is to be clamped, is spaced apart from the clamping plate carrier to a more or less pronounced extent. Between these two, it is then possible to arrange a compensation section, for example a spring, an elastic intermediate layer or the like, which, depending on the distance between the clamping plate and the clamping-plate carrier, is elastically deformed to a more or less pronounced extent.

In the case of further preferred variants of the franking machine according to the invention, the clamping unit comprises a clamping plate, a second compensation section being arranged on the clamping plate. It is thus possible for the clamping plate, for example, itself to consist, wholly or partially, of a corresponding elastic material.

In the case of further advantageous variants of the franking machine according to the invention, it is provided that the gearing device comprises at least a first gearing element and a second gearing element which is coupled to the first gearing element via a coupling element, a third compensation section being arranged on the coupling element. In other words, it is possible here for straightforward structural elements, such as lever arms, gearwheels or the like, to be coupled to one another via a coupling element which is provided between them and then provides the thickness compensation by elastic deformation.

In the case of variants of particularly straightforward construction, the first gearing element or the second gearing element comprises, preferably both gearing elements comprise, a lever arm.

It goes without saying that the compensation section may be made up of different components, layers or elements, since it is hereby possible to adjust within wide limits the desired properties of the compensation section in terms of the characteristic deformation curve, the service life, etc.

For the compensation section, it is possible to use any desired sufficiently elastic materials which ensure sufficiently long service life. The compensation section preferably consists, at least in part, of one or more spring materials, since these materials usually satisfy this requirement particularly well.

Appropriate metals, metal alloys, etc. may be used as the spring materials. In the case of further favorable variants, the compensation section consists, at least in part, of an elastic plastic or plastic mixture. It is possible for these to be made into any desired shape particularly easily and to be reinforced by appropriate reinforcing inserts and the like. Other features which are considered as characteristic for the invention are set forth in the appended claims.

Although the invention is illustrated and described herein as embodied in a franking machine having a clamping device for an item of mail, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
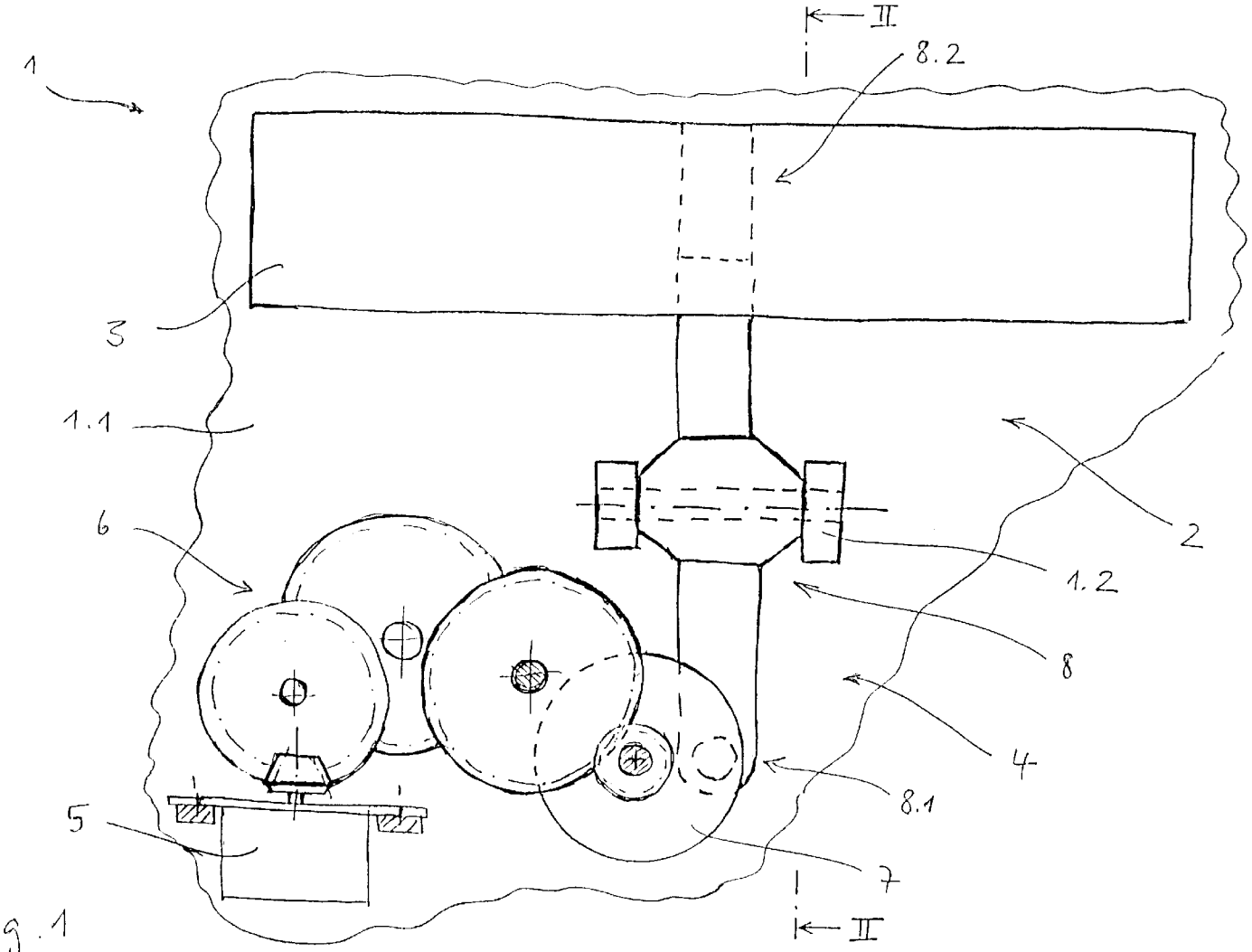
FIG. 1 shows a view of part of a preferred exemplary embodiment of the franking machine according to the invention.

Referring now to the figures of the drawing in detail and first, particularly, to FIG. 1 thereof, there is shown a part of a preferred configuration of a franking machine 1 according to the invention, namely of a clamping device 2 thereof for securely clamping an item of mail, for example a letter, which is to be franked.

The clamping device 2 has a clamping unit which is provided for interacting with the item of mail and is in the form of a clamping plate 3. The clamping plate 3 is connected to a drive device in the form of a motor 5 via a gearing device 4. The gearing device 4 here comprises a toothed gear mechanism 6 which drives a cam plate 7 which, in turn, interacts with a first free end 8.1 of a first lever arm in the form of a rocking lever 8. The clamping plate 3 is arranged at a second free end 8.2 of the rocking lever 8.

The rocking lever 8 is pivotally mounted in bearing blocks 1.2 arranged on the housing 1.1 of the franking machine 1. The free end 8.1 of the rocking lever 8 is prestressed against the cam plate 7 by a non-illustrated spring device. As a result, there is always contact between the contact element 8.3 at the first free end 8.1 of the rocking lever 8 and the cam surface 7.1 of the cam plate 7.

Figure 2:
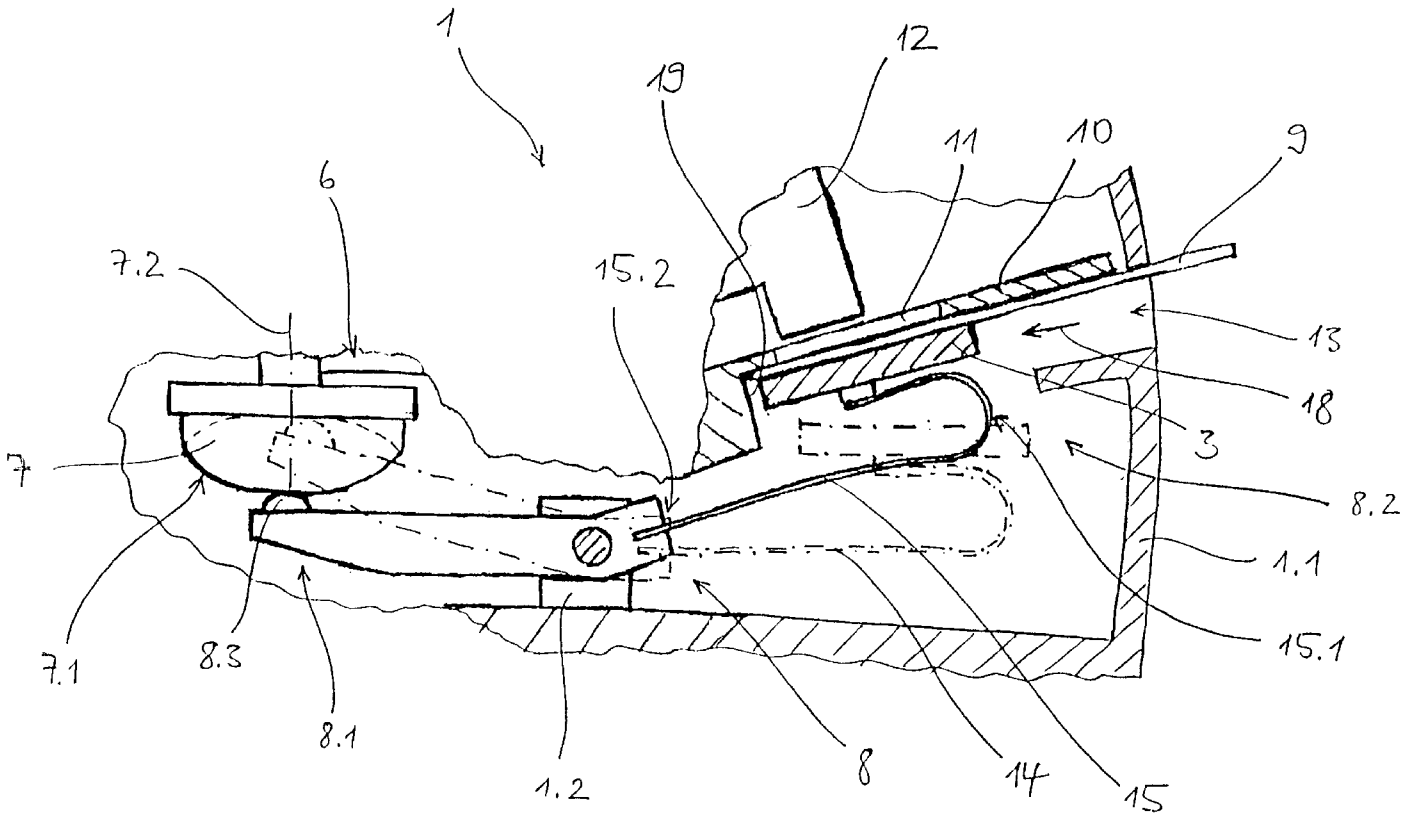
FIG. 2 is a section, taken along line II—II, through part of the franking machine of FIG. 1.

With reference to FIG. 2, the clamping plate 3 presses an item of mail, for example a letter 9, against a stop plate 10, wherein a printing window 11 is formed. The printing window 11 is assigned a print head 12 which can be displaced—inter alia perpendicularly to the plane of the drawing—and by means of which the franking imprint can be printed onto the letter 9 through the printing window 11.

For secure clamping of the letter 9 introduced through an insertion slot 13 in the housing 1.1 of the franking machine 1, the rocking lever 8, with the clamping plate 3, is pivoted from a first position, which is indicated by the contour 14, into the second position, which is illustrated. In this case, the cam plate 7 driven by the motor 5, to which it is connected via the toothed gear mechanism 6, executes half a revolution about its axis 7.2.

This displacement of the cam plate 7 and the associated drive displacement or angular rotation of the motor 5 are identical for each item of mail, irrespective of the thickness of the respective item of mail introduced through the insertion slot 13. Compensation for different thickness dimensions of the items of mail introduced is provided by elastic deformation of a first compensation section in the form of a leaf-spring-like spring section 15 of the rocking lever 8.

Figure 3:
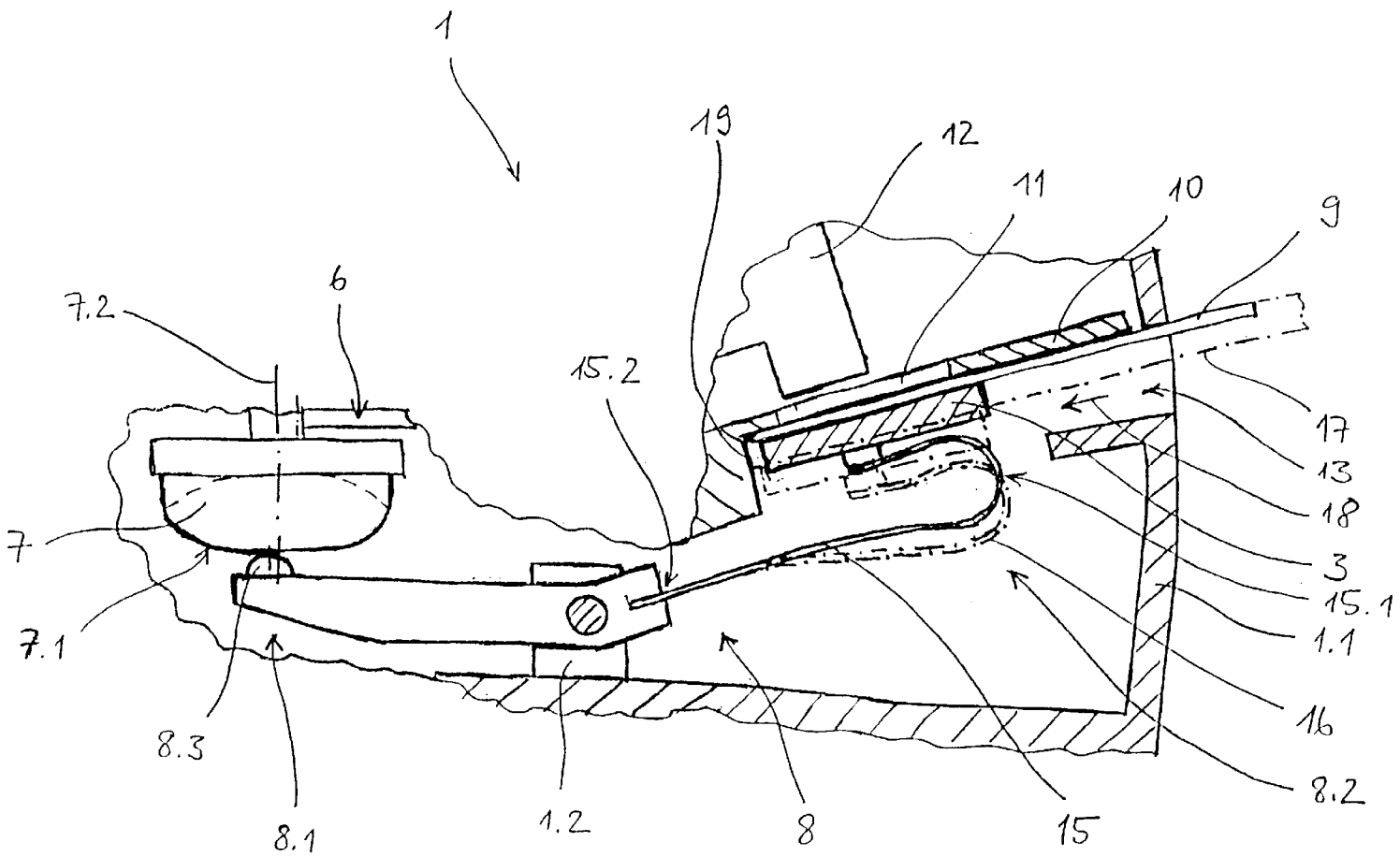
FIG. 3 is a section, taken along line II—II, through part of the franking machine from FIG. 1.

Depending on the thickness of the item of mail introduced, this spring section 15 is deformed to a more or less pronounced extent, as can be gathered from FIG. 3, which shows the same partial section as FIG. 2. In FIG. 3, however, the contour 16 indicates the deformation of the spring section 15 to which the latter is subjected during the secure clamping of an item of mail of maximum processable thickness, said item of mail being indicated by the contour 17.

The spring section 15 is arranged and designed such that, even in the case of a minimal thickness of the item of mail introduced, it is also subjected to a certain degree of deformation in the second position of the rocking lever 8. The level of deformation here is high enough to ensure a predetermined minimal clamping force. This ensures that a sufficiently high clamping force is still achieved even when, for example, just a single sheet, for example a franking strip for a package, etc. is to be printed.

The spring section 15 also has a bending section 15.1 with a U-shaped profile. This bending section 15.1 not only ensures a force introduction into the spring section 15 which is favorable in terms of deformation. It also ensures that, despite the small distance between the clamping plate 3 and the fastening point 15.2 of the spring section 15 on the rocking lever 8, the spring section 15 is of a relatively long length. This has an advantageous effect on the characteristic deformation curve of the spring section 15 insofar as it achieves a particularly smooth characteristic deformation curve, which ensures that, during the secure clamping of items of mail of different thicknesses, only a comparatively low variation in the establishing clamping force is produced.

A further advantage of the U-shaped configuration of the spring section 15 can be seen in the fact that, during the secure clamping of the letter 9, on account of the radius of curvature of the bending section 15.1 decreasing more and more as the deformation continues, the clamping plate 3 moves toward the letter stop 19 in the introduction direction 18. As a result, the letter 9 is advantageously pressed against the letter stop 19 or even drawn against the same.

In the illustrated exemplary embodiment, the spring section 15 consists of a conventional spring steel. It will be readily understood, however, that, in the case of other variants, it is also possible to use any other desired materials or material mixtures or material combinations having an appropriate level of elasticity.

It likewise understood that, in the case of other variants of the invention, it is also possible for the entire, or more less the entire, rocking lever to comprise such a spring section, as a result of which it is possible to achieve a particularly long length of the spring section with the above-described advantageous effects.

Figure 4:
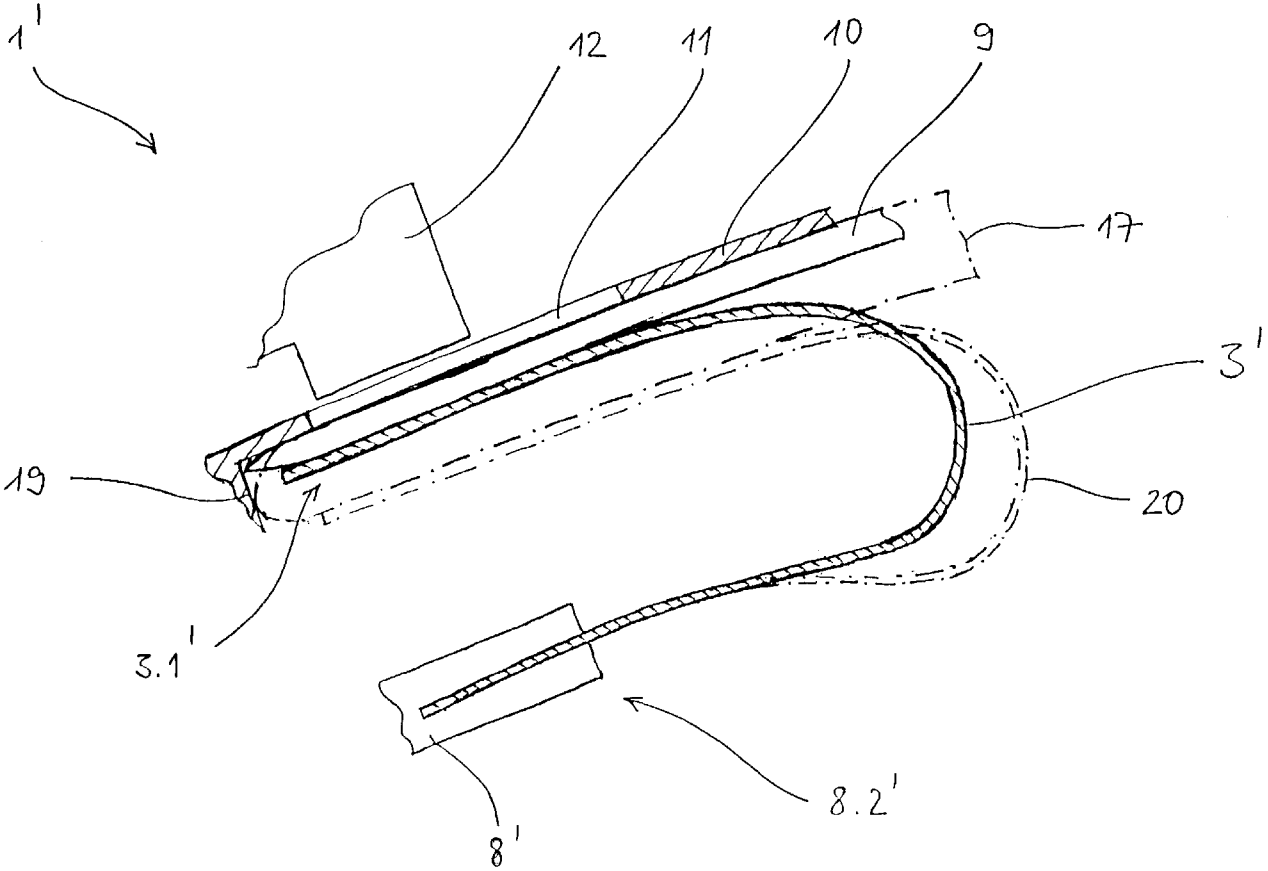
FIG. 4 is a section through part of a further preferred exemplary embodiment of the franking machine according to the invention.

FIG. 4 shows a section through part of a further preferred exemplary embodiment of the franking machine 1' according to the invention, which, in terms of its basic construction and functioning, is the same as the exemplary embodiment from FIGS. 1 to 3, so that only the differences will be discussed here. Accordingly, identical components, moreover, have the same designations as in FIGS. 1 to 3.

The difference is that a clamping plate 3' formed by a U-shaped elastic plastic component is provided at the second free end 8.2' of the rocking lever 8'. This clamping plate 3' constitutes a second compensation section, which ensures that, with the end position always remaining constant, i.e. with the second position of the second end 8.2' of the rocking lever 8' always remaining constant, it is possible to clamp items of mail 9, 17 of different thicknesses.

Depending on the thickness of the item of mail introduced, the elastic clamping plate 3' is deformed to a more or less pronounced extent for thickness compensation, as can be gathered from FIG. 4, wherein the contour 20 indicates the deformation of the elastic clamping plate 3' to which the latter is subjected during the secure clamping of an item of mail of maximum processable thickness, said item of mail being indicated by the contour 17.

It will be understood that, in the case of other variants of the franking machine according to the invention, it is also possible for just part of the clamping plate to be of correspondingly elastic design. It is thus also possible, for example, in the region of the free end 3.1' of the clamping plate, to provide a rigid section on the clamping plate.

Figure 5:
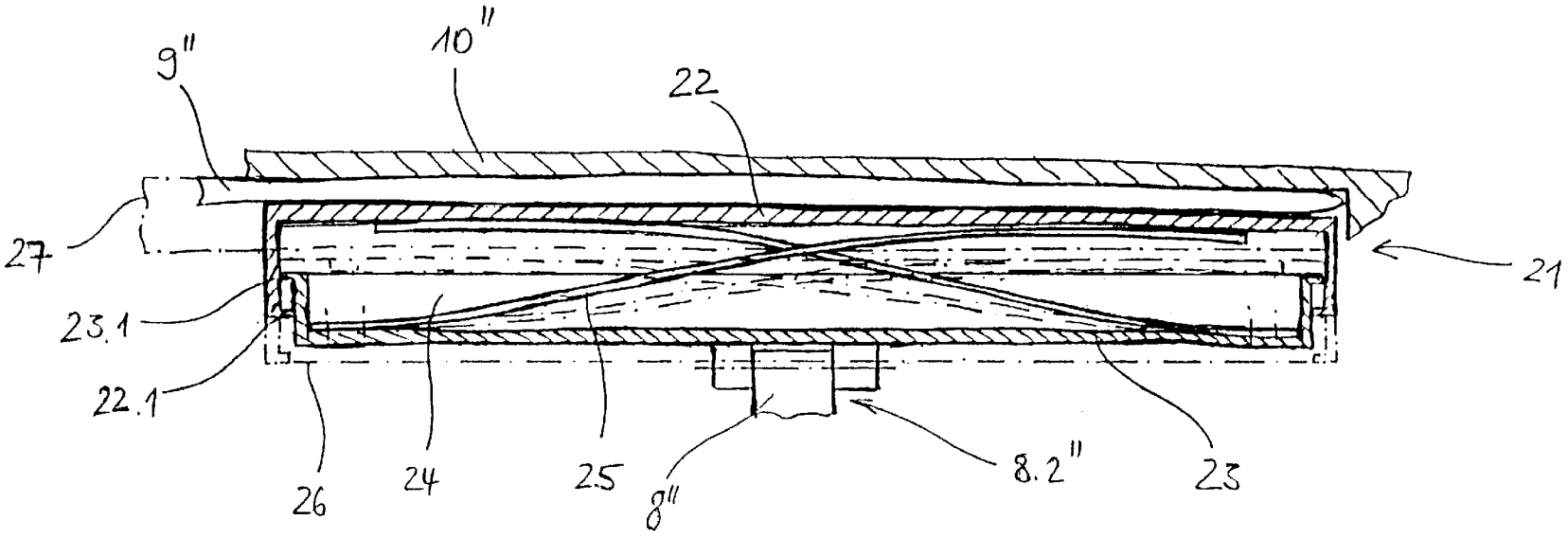
FIG. 5 is a section through part of a further preferred exemplary embodiment of the franking machine according to the invention.

FIG. 5 shows a section through part of a further variant of the franking machine according to the invention, namely, through a clamping unit 21 which is arranged in an articulated manner at the second end 8.2" of an essentially rigid rocking lever 8". This rocking lever 8" is actuated, for secure clamping of an item of mail 9" against a stop plate 10", in the same way as has been described for the above examples, so that this will not be discussed in any more detail.

The clamping unit 21 comprises a shell-like clamping plate 22 and a likewise shell-like carrier 23 connected to the clamping plate, the clamping plate and carrier defining a cavity 24. Arranged in this cavity 24 are leaf springs 25 which are fixedly connected to the carrier 23 at one end, while, by way of their other end, they press against the inside of the clamping plate 22 in a freely movable manner. In order to prevent the clamping plate 22 from being lifted off from the carrier 23 in the open state of the clamping device—this state not being illustrated—stops 22.1 and 23.1 are provided.

Depending on the thickness of the item of mail introduced, the clamping plate 22 is moved in the direction of the carrier 23 to a more or less pronounced extent for thickness compensation, with more or less pronounced deformation of the leaf springs 25, which in this case constitute the second compensation section, this being shown in FIG. 5, wherein the contour 26 indicates the inward deflection of the clamping plate 22 to which the latter is subjected during secure clamping of an item of mail of maximum processable thickness, said item of mail being indicated by the contour 27.

The length of the leaf springs 25 ensures here that a sufficiently smooth characteristic deformation curve of the clamping unit 21 is produced, this ensuring the lowest possible variation in the clamping force over the range of thicknesses of the items of mail which are to be processed.

Figure 6:
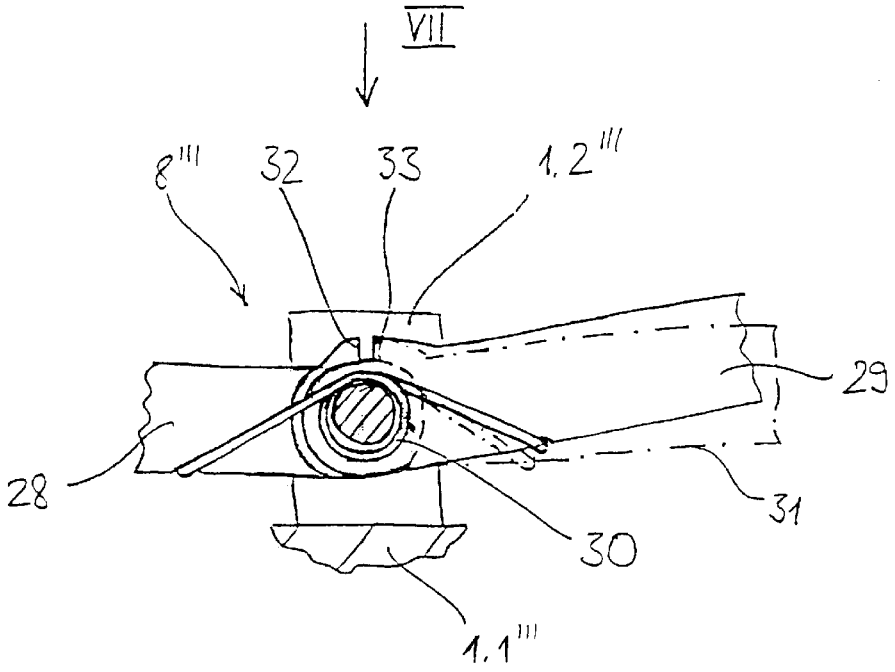
FIG. 6 is a section through part of a further preferred exemplary embodiment of the franking machine according to the invention.
Figure 7:
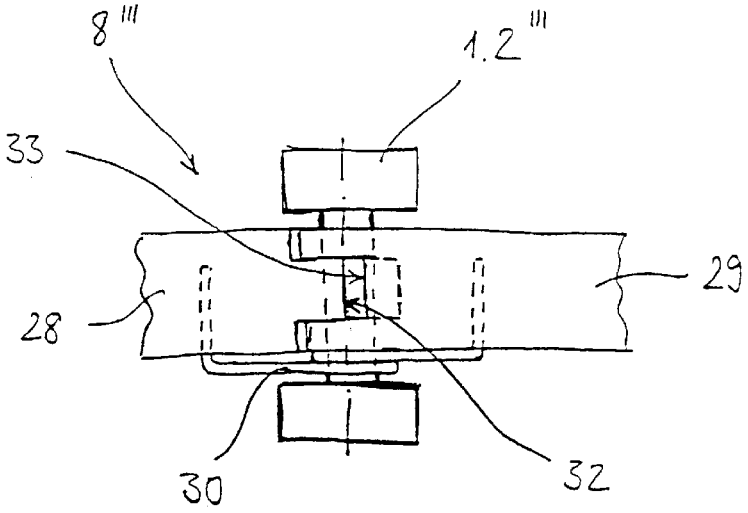
FIG. 7 is a plan view of the exemplary embodiment of FIG. 6 viewed in the direction VII.

FIGS. 6 and 7 show views of part of a further variant of the franking machine according to the invention, namely in the region of the bearing blocks 1.2'" via which a rocking lever 8'", which is illustrated in its second position, is mounted pivotably on the housing 1.1'" of the franking machine. This rocking lever 8'" is actuated, for secure clamping of an item of mail, in the same manner as has been described for the above examples, so that this will not be described in any more detail. Fastened here at the second end of said lever is one of the abovedescribed clamping units, via which the item of mail is clamped against a stop plate.

The special feature of the rocking lever 8'" resides in its being configured in two parts from a lever arm 28 which constitutes a first gearing element, and a lever arm 29, which constitutes a second gearing element, the two lever arms being coupled via a coupling element in the form of a spring 30 shaped in the manner of a clothes-peg spring.

Depending on the thickness of the item of mail which is to be clamped, the spring 30, which in this case constitutes the first compensation section, is deformed to a more or less pronounced extent for thickness compensation. This produces a more or less obtuse angle between the two lever arms 28 and 29, as can be gathered from FIG. 6, wherein the contour 31 indicates the angular position between the two lever arms 28 and 29 which the latter assume during the secure clamping of an item of mail of maximum processable thickness.

In the first position—which is not illustrated for purposes of clarity—of the rocking lever 8'", that is to say with the clamping device open, the two stop surfaces 32 and 33 of the two lever arms 28 and 29 butt against one another under the influence of the restoring forces of the spring 30, this producing a defined rest position for the two lever arms 28 and 29 in relation to one another.

The length of the spring wire used overall for the spring 30 ensures here that a sufficiently smooth characteristic deformation curve of the spring 30 is produced, this ensuring the lowest possible variation in the clamping force over the range of thicknesses of the items of mail which are to be processed.

Although, in the above examples, in each case only one compensation section has been described for the respective variant of the franking machine according to the invention, it goes without saying that, in the case of other variants, it is also possible to use a number of such compensation sections in any desired combination.

We claim:

1. A franking machine, comprising:

a clamping device configured to clamp an item of mail to be franked against a stop element;

a drive device for driving said clamping device;

said clamping device including a clamping unit configured to interact with the item of mail, and a gearing device connected to said clamping unit and said drive device for displacing said clamping unit in a direction towards said stop element;

said gearing device having a lever arm and an elastic compensation section being disposed on said lever arm, said compensation section, upon a predetermined drive displacement of said drive device, compensating for different thicknesses of the item of mail by elastic deformation of said compensation section.

2. The franking machine according to claim 1, wherein said compensation section is formed by a leaf-spring-type spring section of said lever arm.

3. The franking machine according to claim 2, wherein said spring section has at least one bending section with a U-shaped profile.

4. The franking machine according to claim 1, wherein said clamping unit comprise a clamping plate, and a compensation section is disposed on said clamping plate.

5. The franking machine according to claim 1, wherein said clamping unit comprises a clamping plate forming a compensation section.

6. The franking machine according to claim 1, wherein at least a part of said compensation section is formed of a spring material.

7. The franking machine according to claim 1, wherein at least a part of said compensation section is formed of an elastic plastic material.

8. A franking machine, comprising;

a clamping device configured to clamp an item of mail to be franked against a stop element;

a drive device for driving said clamping device;

said clamping device including a lamping unit configured to interact with the item of mail, and a gearing device connected to said clamping unit and said drive device for displacing said clamping unit in a direction towards said stop element;

said gearing device including at least a first gearing element and a second gearing element coupled to said first gearing element via a coupling element, and said gearing device having an elastic compensation section disposed on said coupling element, said compensation section, upon a predetermined drive displacement of said drive device, compensating for different thicknesses of the item of mail by elastic deformation of said compensation section.

9. The franking machine according to claim 8, wherein at least one of said first gearing element and said second gearing element is a lever arm.

10. The franking machine according to claim 8, wherein at least a part of said compensation section is formed of a spring material.

11. The franking machine according to claim 8, wherein at least a part of said compensation section is formed of an elastic plastic material.

12. A franking machine, comprising:

a clamping device configured to clamp an item of mail to be franked against a stop element;

a drive device for driving said clamping device;

said clamping device including a clamping unit configured to interact with the item of mail, and a gearing device connected to said clamping unit and said drive device for displacing said clamping unit in a direction towards said stop element;

said gearing device including at least a first gearing element and a second gearing element coupled to said first gearing element via a coupling element forming an elastic compensation section, said compensation section, upon a predetermined drive displacement of said drive device, compensating for different thicknesses of the item of mail by elastic deformation of said compensation section.

13. The franking machine according to claim 12, wherein at least one of said first gearing element and said second gearing element is a lever arm.

14. The franking machine according to claim 12, wherein at least a part of said compensation section is formed of a spring material.

15. The franking machine according to claim 12, wherein at least a part of said compensation section is formed of an elastic plastic material.

* * * * *